US005499716A

United States Patent [19]

Gardner

[11] Patent Number: 5,499,716

[45] Date of Patent: Mar. 19, 1996

[54] PAN PACKAGING AND DISPLAY SYSTEM

[75] Inventor: John R. Gardner, Markesan, Wis.

[73] Assignee: PanGard, Inc., Milwaukee, Wis.

[21] Appl. No.: 277,895

[22] Filed: Jul. 20, 1994

[51] Int. Cl.[6] ..... B65D 1/34; B65D 21/00

[52] U.S. Cl. ..... 206/553; 206/499; 206/507; 220/507

[58] Field of Search ..... 206/564, 509, 206/511, 507, 499, 553; 220/23.83, 507, 555, 912

[56] References Cited

U.S. PATENT DOCUMENTS

| | | | |
|---|---|---|---|
| 2,594,483 | 4/1952 | Naken | 206/553 X |
| 3,203,573 | 8/1965 | Rowe | 206/507 X |
| 3,372,812 | 3/1968 | Parcels | 206/511 X |
| 4,195,732 | 4/1980 | Bell | 206/593 X |
| 4,435,463 | 3/1984 | Roellchen | 206/391 X |
| 4,832,196 | 5/1989 | Butler | 206/391 |
| 4,936,450 | 6/1990 | Paul | 206/386 |
| 5,060,819 | 10/1991 | Apps | 206/511 X |

*Primary Examiner*—Paul T. Sewell
*Assistant Examiner*—Ted Kavanaugh
*Attorney, Agent, or Firm*—Andrus, Sceales, Starke & Sawall

[57] ABSTRACT

A package component for protectively supporting and displaying implements such as frying pans having a generally continuous periphery comprises a tray-like base having an upper surface provided with a plurality of spaced, parallel ribs, each defining an implement or pan receiving pocket which merges into a generally horizontally extending land having an underside formed with an implement or pan receiving surface generally complementary to the shape of each of the implement or pan receiving pockets.

13 Claims, 6 Drawing Sheets

FIG. 7
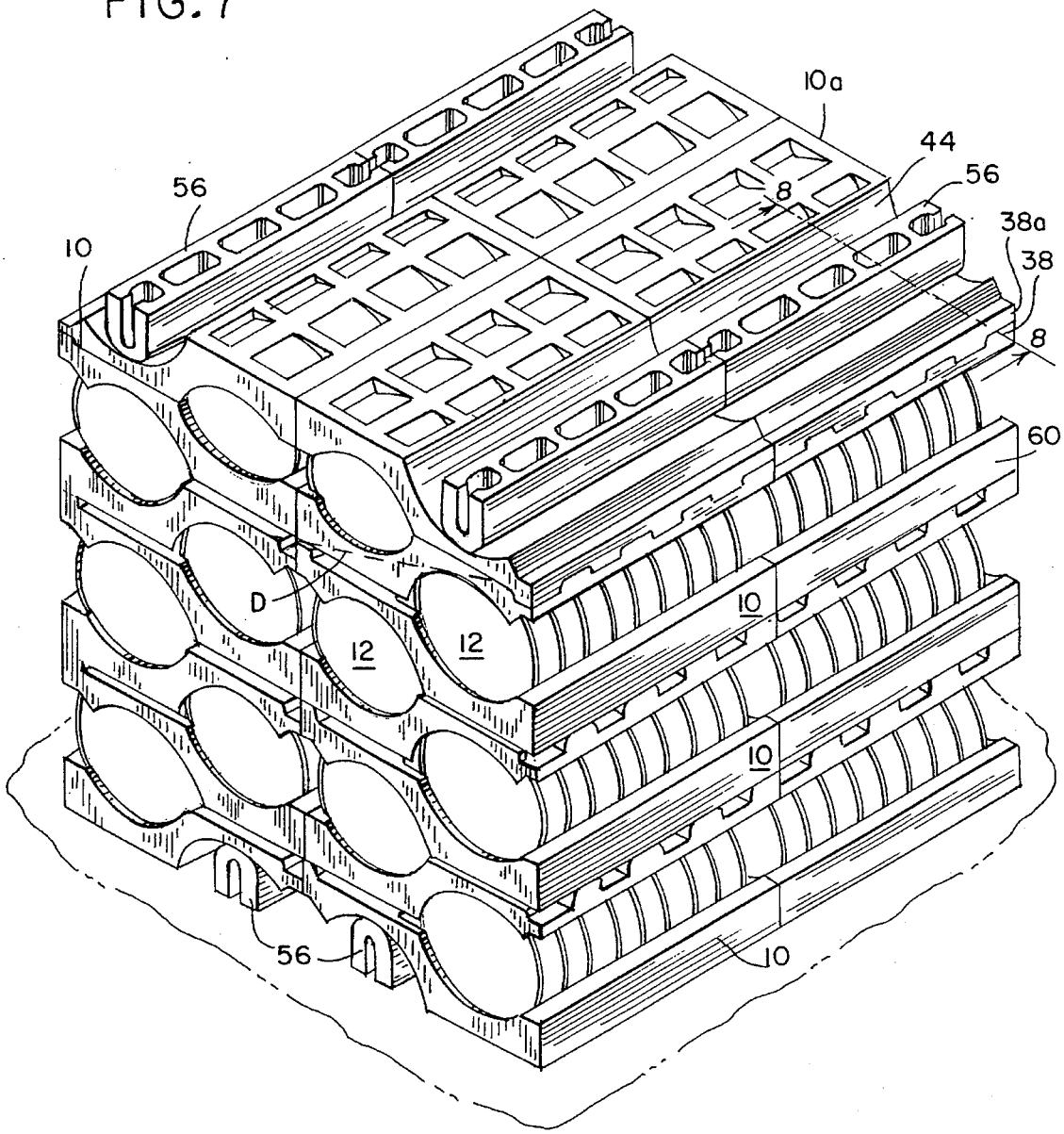
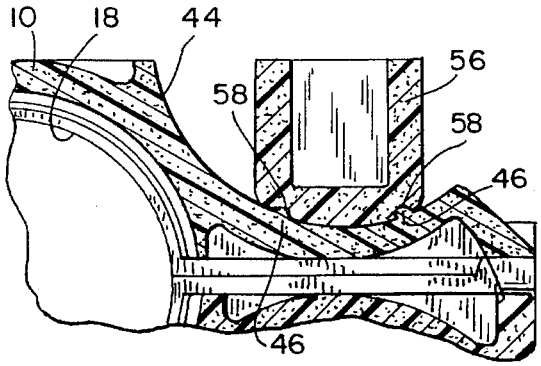
FIG. 8

FIG. 9
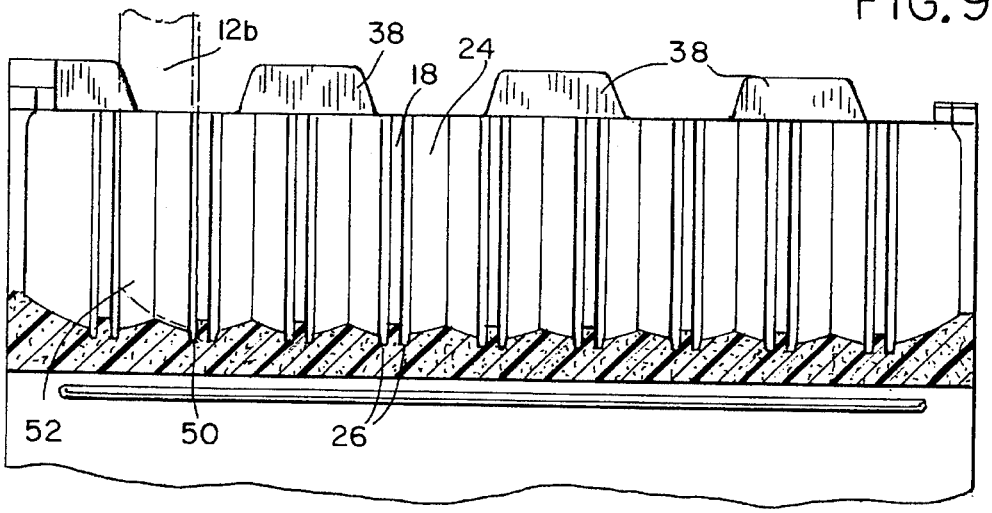
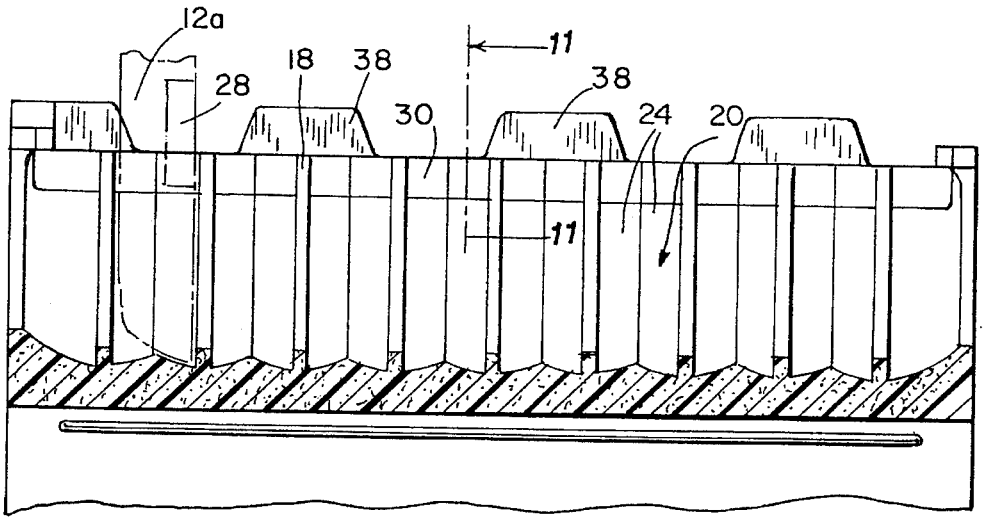
FIG. 10
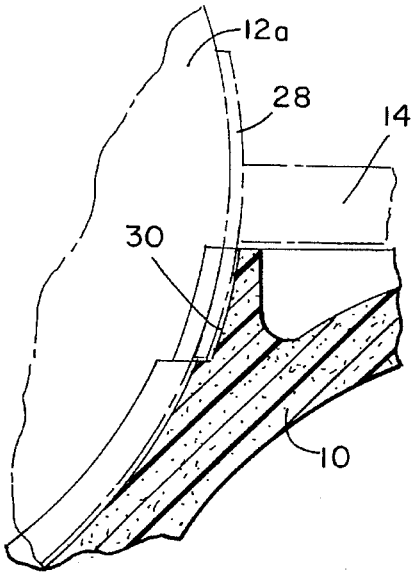
FIG. 11

FIG. 12
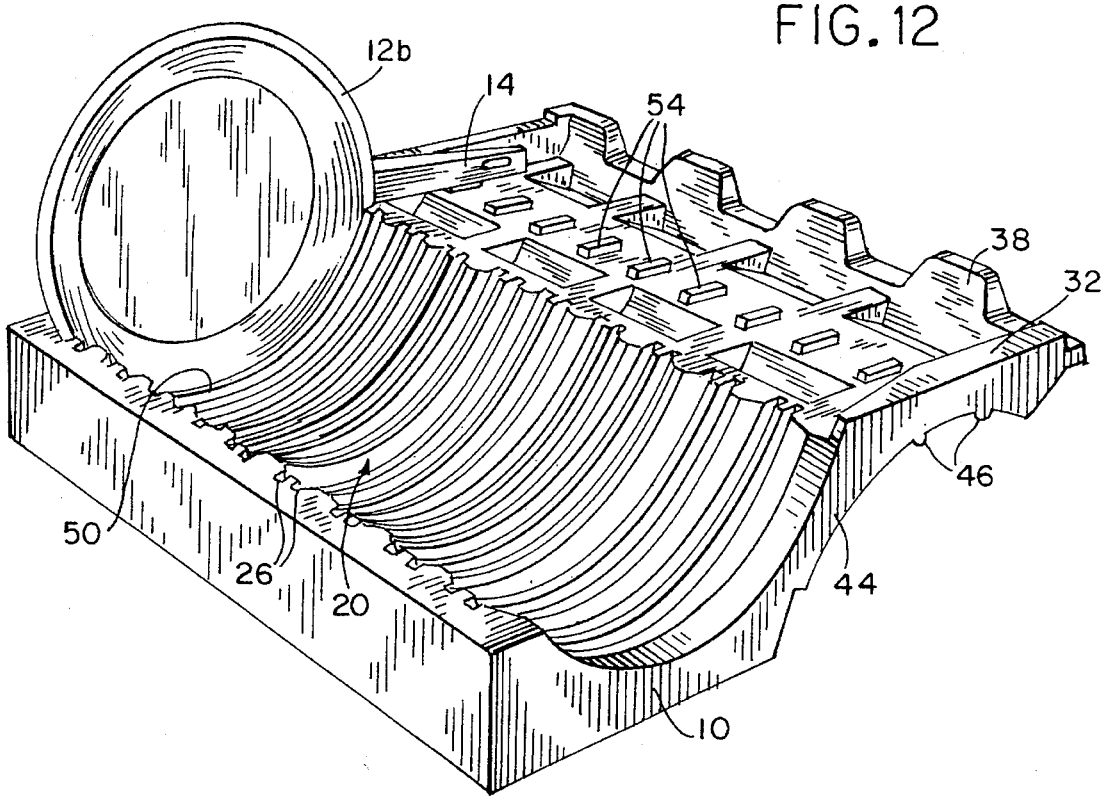
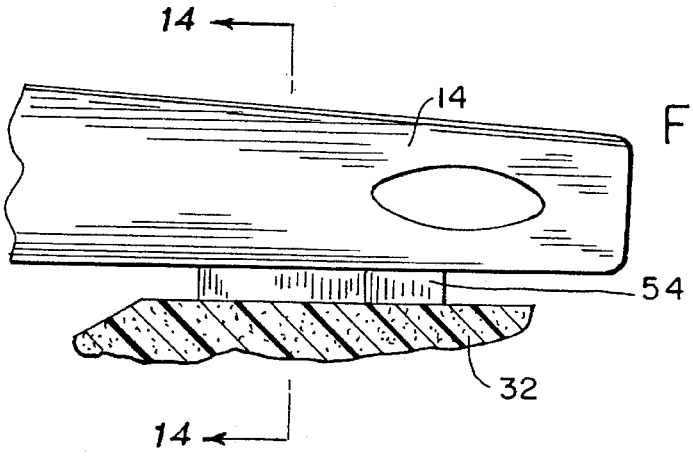
FIG. 13
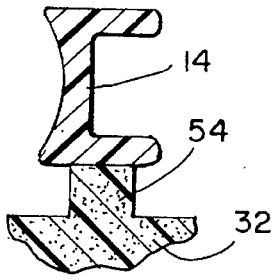
FIG. 14

PAN PACKAGING AND DISPLAY SYSTEM

TECHNICAL FIELD AND BACKGROUND OF THE INVENTION

This invention relates to the shipping and displaying of bulky items such as cookware. In particular, the invention relates to a combined transporting and merchandising display device for frying pans.

The need for a shipping container which can also be used as a display has been brought about by the popularity of "warehouse" retail establishments and "outlet" stores. Such retail establishments do little shelving of products, and thereby save on labor related to handling merchandise. Instead, the merchandise is offered for sale directly from the containers in which they are shipped. Frequently, such merchandise will remain on pallets in a warehouse-type environment. Customers are allowed to roam the warehouse to select merchandise from the shipping/display containers. The cost saving which arises from the elimination of shelving labor is passed on, at least in part, to the customer.

Cookware having non-stick surfaces (such as those bearing the brand names Silverstone and Teflon) presents particular problems in designing shipping/display packaging. Non-stick surfaces, in many cases, are relatively easily scratched. Therefore, items having such surfaces must be well supported and separated. At the same time, it is important to present the items to the purchasing public in a visually attractive, yet economical, way.

Frying pans, because of their elongated, rigid handles, present a somewhat awkward shape for the purposes of shipment and display. The handle makes stacking difficult, and the large amount of packaging material required to protect both the handle and the non-stick surface can be costly. Therefore, designing a package which is fully protective of the handle and cooking surfaces which utilizes a minimum of packaging material, while displaying a major portion of the shipped products in an attractive way, is a significant challenge.

One example of a combined shipping and display system in use today is disclosed U.S. Pat. No. 4,936,450 issued Jun. 26, 1990 to Paul. In this arrangement, a package for shipping and displaying cookware includes a pair of substantially identical molded expanded foam trays, each having a plurality of pockets shaped to complementarily engage opposite edges of a frying pan. Each of the trays has two rows of pockets separated by a sloping surface against which handles of pans in one row can rest. One of the trays acts as a base, and the other tray acts as a cover, with the two rows of pans sandwiched therebetween. Each base/cover combination can be banded to form an invertible unit, the units being shaped so that several units can be carried by a pallet to facilitate handling by a forklift. The palletized units can be opened quickly and easily, by customers if necessary, and are immediately ready for use as a display.

Notwithstanding this previous successful design, it remains desirable to provide an improved pan packaging and display system of a modified type from that shown in the aforementioned prior art which is effective to protect and support different types of cookware, is cost effective to manufacture and use, and which continues to present the cookware to the purchasing public in a visually attractive way. It is also highly desirable that such pan packaging and display system offer a limited deformability which will enhance the stability of the pans during transport and display. It is also desirable that the pan packaging and display system of the present invention is completely recyclable and environmentally acceptable.

SUMMARY OF THE INVENTION

The pan packaging and display system of the present invention advantageously provides a reliable organizational handling arrangement which employs a protective packaging method, becomes an effective shipping unit and simultaneously functions as a merchandising display. The system has a unique lightweight construction designed for strength, durability, stackability, and has the capability of being employed with products other than pans.

These and other aspects of the invention are realized in a package component for protectively supporting and displaying implements with a generally continuous periphery comprising a tray-like base having an upper surface provided with a plurality of spaced, parallel ribs defining on each side thereof an implement receiving pocket, each pocket merging collectively into a generally horizontally extending land, the land having an underside formed with an implement receiving surface generally complementary to the arcuate shape of each of the implement receiving pockets.

In another aspect of the invention, a package for shipping and displaying frying pans having handles on edge comprises a plurality of molded tray-like bases dimensioned to be stacked together on a pallet. Each of the bases has an upper surface defining a singular row of arcuate pockets for receiving and supporting one portion of a first set of frying pans on edge, the uppermost locus of the pockets merging into a generally horizontally extending land provided with a series of deformable support cushions for supporting the handles of the first set of frying pans. The underside of the land is formed with an arcuate surface similar to that of the singular row of arcuate pockets for receiving and supporting another portion of a second set of frying pans supported in the singular row of pockets in a cooperating tray-like base having a land supporting the handles of the second set of frying pans and a bottom portion of the singular row of arcuate pockets.

In yet another aspect of the invention there is contemplated a packaging and transport system for displaying and shipping frying pans equipped with handles. The system comprises a plurality of stackable, tray-like elements, each of the elements having first and second oppositely disposed retaining cavities for receiving and supporting a plurality of frying pans on edge in a staggered, horizontal columnar array. Each of the elements has an upper surface and a lower surface, one of the upper surface and the lower surface being formed with a singular row of arcuate pockets defining one of the cavities and the other of the upper surface and the lower surface being formed with a generally smooth arcuate surface generally complementary in configuration to the shape of the arcuate pockets and defining the other of the cavities. A generally horizontally extending surface is located adjacent the singular row of pockets and defines a support land for supporting the handles of the frying pans in a generally horizontal disposition. Each of the elements is capable of supporting a singular row of frying pans on either side of a diagonal axis bisecting the element.

BRIEF DESCRIPTION OF THE DRAWINGS

The invention will become better understood by reference to the following detailed description of the preferred exemplary embodiment when read in conjunction with the appended drawing, wherein like numerals denote like elements and:

FIG. 7 is a perspective view of a plurality of stacked elements with frying pans ready for display or shipping upon a pallet;

FIG. 8 is a detail view in cross-section depicting a support block in position on an element of the present invention;

FIG. 9 is a cross-sectional view similar to FIG. 5 but showing a frying pan with a lip disposed in a modified element of the present invention;

FIG. 10 is a cross-sectional view similar to FIG. 9 but showing a frying pan with a modified handle and support therefor;

FIG. 11 is a cross-sectional view taken on line 11—11 of FIG. 10;

FIG. 12 is a perspective view of a single element of the type shown in FIG. 9 illustrating cushions for supporting the handles of the frying pans;

FIG. 13 is an enlarged detail view of a handle supported by the cushion shown in FIG. 12; and FIG. 14 is a cross-sectional view taken on line 14—14 of FIG. 13.

DETAILED DESCRIPTION OF THE PREFERRED EMBODIMENTS

Figure 1:
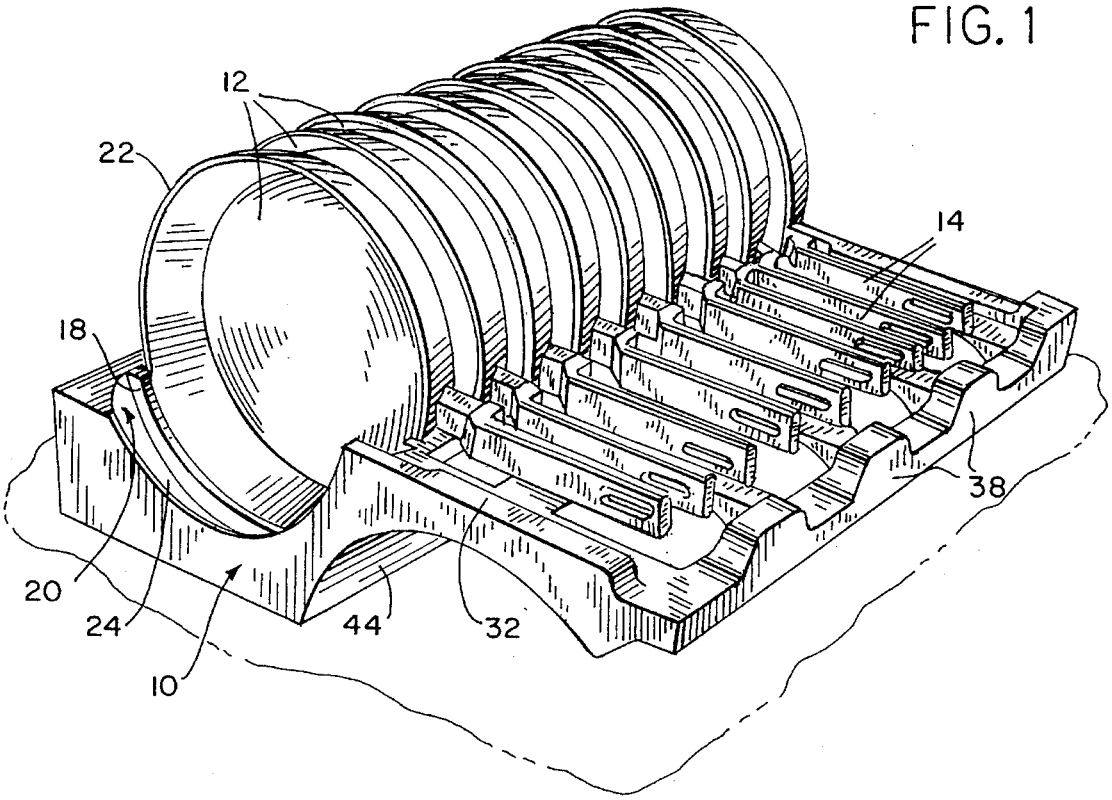
FIG. 1 is a perspective view of a single element made in accordance with the present invention with a plurality of frying pans disposed therein.

Referring now to FIG. 1, there is shown a tray-like base or element 10 comprising a singular component of a packaging and display system embodying the present invention. Each tray-like base or element 10 receives and supports a series of aligned implements having generally continuous peripheries. In the preferred embodiment, these implements take the form of variously modified frying pans 12 equipped with handles 14. FIG. 1, for example, depicts a row of aligned 10 inch diameter lipless, non-stick, circular frying pans 12 having generally L-shaped handles 14 disposed substantially orthogonal to the sides of the frying pans. As will be appreciated hereafter, each tray-like base 10 is particularly formed to efficiently support, retain, protect and display the frying pans 14 during shipping and merchandising.

Figure 2:
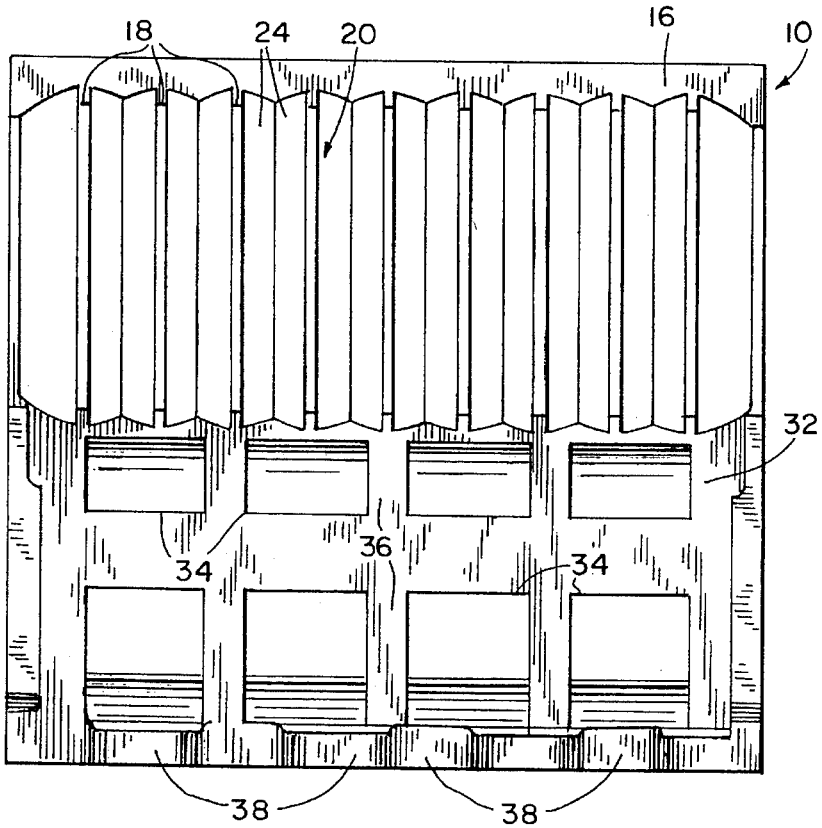
FIG. 2 is a top view of the element shown in FIG. 1 with the pans removed.
Figure 5:
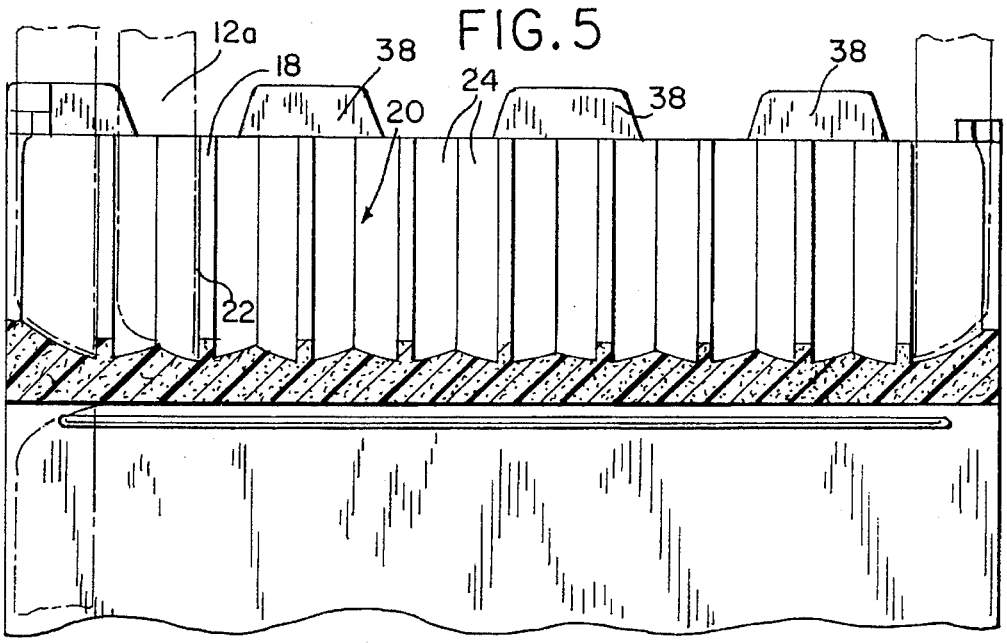
FIG. 5 is a cross-sectional view taken on line 5—5 of FIG. 4.

FIG. 2 illustrates a top plan view of an empty tray-like base or element 10. Each base 10 is somewhat wing-like in configuration and has an upper surface 16 provided with a plurality of identical, spaced, parallel ribs 18, each rib defining on either side thereof an arcuate implement or pan receiving pocket 20. Ribs 18 have a semi-cylindrical arcuate configuration adapted to abut the edges or peripheries 22 of the displayed implements or pans 12. One side of rib 18 permits pans 12 to be displayed in a forward facing orientation and the other side of rib 18 allows pans 12 to be displayed in a rearward facing orientation. Flanking and downwardly sloping towards each rib 18 is an arcuately-shaped ridge 24 which together with rib 18 defines pocket 20 and serves to support a side portion of the pan 12 as its edge 22 abuts against one side of each rib 18. As seen in FIG. 5, the depth of pockets 20 is deep enough to accommodate lipless pans 12*a* as well as lipped pans 12*b*, as shown in FIGS. 9 and 12. In this latter version, each pocket 20 includes a groove 26 on each side of ridge 24 to specifically receive the lip of the pan 12. In addition, the invention contemplates accommodating a lipless pan 12*a* having a handle support 28 and a recess 30 therefor as illustrated in FIGS. 10 and 11. In this design, the uppermost portion of each pocket 20 is provided with a cutout 30 into which the handle support 28 snugly fits. As best appreciated in FIGS. 1 and 2, the uppermost locus of the pockets 20 merges or flows into a generally horizontally extending land 32 for supporting the handles 14 of the pans 12. The upper surface of each base 10 is also formed with a series of recesses 34 to eliminate unnecessary material and at the same time form reinforcing ribs 36 to add structural integrity to each base 10. On the remote end of land 32 is a series of generally trapezoidal teeth 38 that interlock with similar teeth formed on an invertible base 10 which serves as a cover, to be explained further hereafter.

Figure 3:
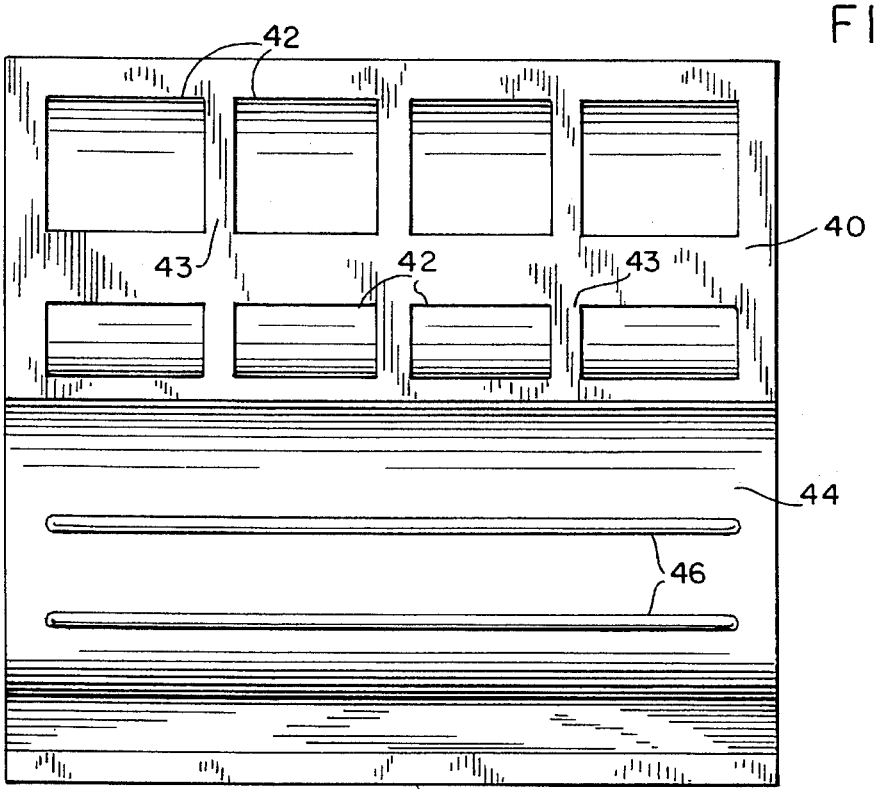
FIG. 3 is a bottom view of the element shown in FIG. 2.
Figure 4:
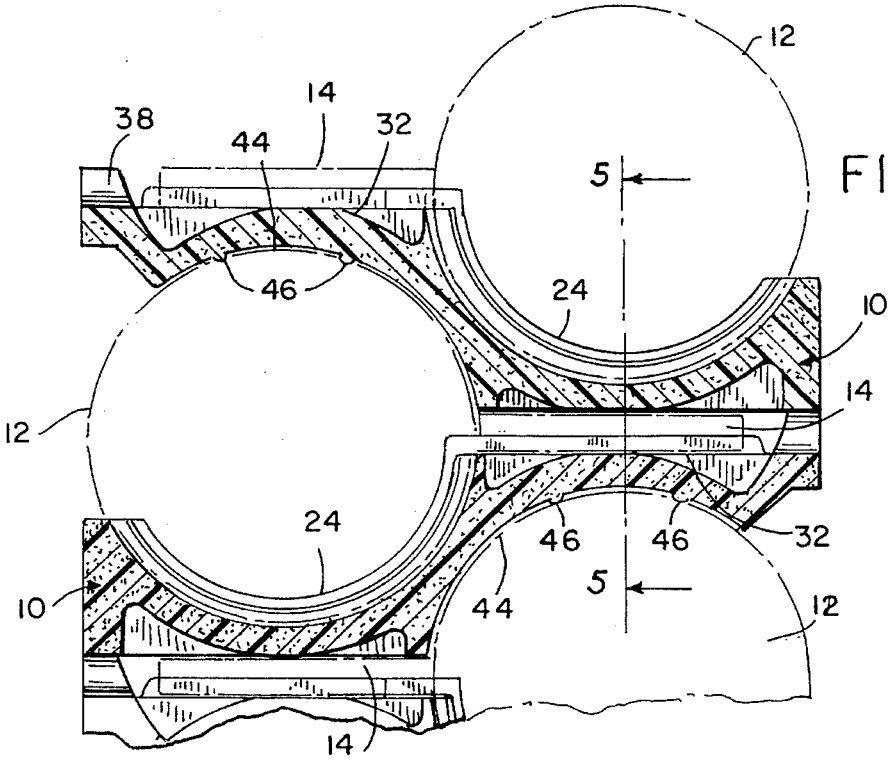
FIG. 4 is a cross-sectional view taken through a central portion of a plurality of stacked elements of the present invention.

Turning now to FIG. 3, the bottom 40 of each base 10 is also provided with a series of recesses 42 to define reinforcing ribs 43 underlying the singular row of pockets 20. On the underside of the land 32 is an arcuate surface 44 similar in configuration to the singular row of pockets 20. As seen in FIG. 4, the purpose of arcuate surface 44 is to receive and support a portion of a set of frying pans 12 supported in the singular row of pockets 20 of a cooperating tray-like base 10 having a land 32 supporting the handles 14 of a set of frying pans 12. The arcuate surface 44 includes a pair of elongated, spaced, parallel ribs 46 disposed transverse to the edges 22 of the frying pans 12 supported in the singular row of arcuate pockets 20. As a feature of the invention, ribs 46 are deformably crushable or collapsible on the edges 22 of frying pans 12 to provide a snug positioning of the frying pans 12 along a half portion thereof.

The sectional views of FIGS. 5, 9 and 10 clearly emphasize the particular shape of pockets 20 on either side of the ribs 18 which ensure support for differently shaped pan edges 22. For example, in FIG. 5, the generally spherical shape of frying pan 12 conforms to ridge 24 while its edge 22 abuts one side of rib 18 to display and support the pan 12 with its edge 22 facing towards the right. The pocket 20 of FIG. 9 is formed not only by ridge 24 but also by adjoining groove 26 which securely accommodates the cylindrical lip 50 while the ridge 24 supports the spherical portion 52 of the pan 12. If a different orientation (that is, to the left) is desired, the groove on the opposite side of the rib 18 is used to position the lipped pan 12*a*. FIGS. 12–14 also show a series of raised cushions 54 on land 32 for supporting handles 14 which cushions are slightly deformable upon stacking of bases 10 to provide further securement for the handles 14. As previously noted, the design shown in FIG. 10 is similar to FIG. 5 with the exception that recessed provisions 30 are made at the upper end of pockets 20 to receive handle supports 28.

FIG. 7 shows a typical transport and display system employing four quadrants or packages of tray-like bases 10 stackable vertically adjacent each other to receive, support and display a plurality of frying pans on edge in a staggered, horizontal columnar array. It can also be seen that each tray-like base 10 is capable of supporting a singular row of frying pans 12 on either side of a diagonal axis D bisecting each base as shown in FIG. 7. While the system shown is ready for display, it should be understood that the entire array is normally shipped upon a supporting pallet and then banded or wrapped to maintain stability and further protect the pans 12. In the preferred embodiment, each package comprises six tray-like bases 10, an invertible tray-like base 10*a* which serves as a cover, and a U-shaped support block 56 disposed in the arcuate surface 44 of cover 10*a* and in the arcuate surface 44 of the bottom most tray-like base 10.

As seen in FIG. 8, support block 56 is formed with two elongated grooves 58 which mate with ribs 46 formed on the arcuate surface 44 to add structural rigidity to the package. It should also be appreciated that the invertible base 10 forming the cover has interlocking teeth 38*a* which mesh with mating teeth 38 on the underlying base 10 so that the cover will continue to protect the underlying pans 12. In use, cover 10*a* and uppermost support block 56 are removed, so that the customer may simply select a frying pan 12 from the stacked package. When one complete horizontal row of pans is removed, the empty tray-like base 10 is easily removed or discarded revealing an immediately available underlying row of pans 12 for further sale.

Exterior surfaces 60 of the bases are suitably textured for the attachment of advertising labels and the like so that a minimum of label adhesive is needed. This allows easier removal of the labels to ease foam recycling alternatives.

Figure 6:
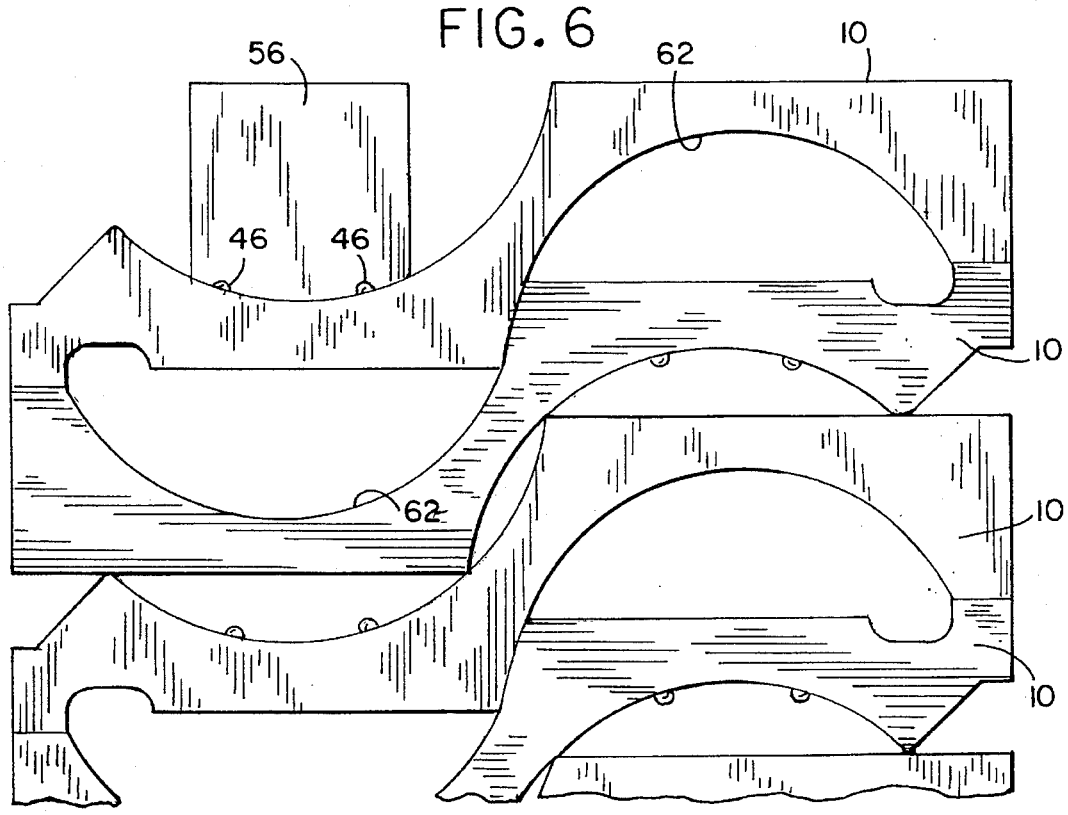
FIG. 6 is an end view of a plurality of stacked elements of the present invention without frying pans.

FIG. 6 depicts the manner in which discarded or unused tray-like bases 10 may be nested vertically. One can appreciate the stacked, emptied bases 10 whereupon the arcuate cavities 62, which in use are adapted to receive pans 12 in pockets 20, define an S-shaped configuration which is low profile and takes up a minimum of space.

Each base 10 and support block 56 is preferably molded from 100% recyclable, expandable polystyrene foam (EPS) which is non-toxic, does not react with water to pose leaching problems or decompose to create volatile methane gas. EPS also is free from chloroflurocarbons which can damage the ozone layer before and after production. If incinerated, EPS burns clean, producing 99% carbon dioxide and water. Because EPS products do not promote bacterial growth, they lower the potential of health hazards and disease transmission.

The packaging and display system of the present invention remains convenient and economical from a labor saving and point-of-purchase standpoint. The various ribs 18, 46, ridges 24, interlocking teeth 38, 38*a*, arcuate surfaces 44, and lands 32, combine to produce a lightweight yet extremely durable and stable display and shipping unit which allows pans 12 to be attractively presented for sale in much the same form as the package is shipped. It is an attractive feature of the invention that the retained implements or pans 12 may be of different types and displayed in either direction.

While the invention has been described with reference to a preferred embodiment, those skilled in the art will appreciate that certain substitutions, alterations and omissions may be made without departing from the spirit thereof. For example, the ribs 18, pockets 20 and arcuate surfaces 44 could be suitably formed to accept square pans or the like. Accordingly, the foregoing description is meant to be exemplary only and should not be deemed limitative on the scope of the invention set forth in the accompanying claims.

I claim:

1. A package for shipping and displaying frying pans having handles positioned on edge comprising a plurality of molded bases, dimensioned to be stacked together in layered formation, there being an uppermost base and a lowermost base, each of said bases having an upper surface defining a singular row of arcuate pockets having an uppermost locus, said pockets receiving and supporting a portion of a first set of frying pans on edge, the uppermost locus of said pockets merging into a generally horizontally extending land having a topside and an underside, said topside being provided with a series of deformable, raised support cushions for supporting the handles of the first set of frying pans, the underside of said land formed with an arcuate surface similar to the configuration of said singular row of arcuate pockets for receiving and supporting a portion of a second set of frying pans supported in said singular row of pockets of a cooperating base having a land supporting the handles of the second set of frying pans and a portion of said singular row of arcuate pockets.

2. The package of claim 1, including a pair of spaced, parallel ribs formed on said arcuate surface and disposed transverse to the edges of the frying pans supported in said singular row of arcuate pockets.

3. The package of claim 2, wherein said ribs are deformably collapsible to conform to the edges of said second set of frying pans.

4. The package of claim 1, wherein each of said bases is formed with a plurality of recesses on either side of said support cushions and on the underside of said singular row of pockets to define structural support ribs for strengthening the package.

5. The package of claim 1, wherein said singular row of arcuate pockets is defined by an angled, arcuate ridge sloping downwardly on each side towards an arcuate support rib capable of cooperating with said ridge for supporting said first set of frying pans on edge so as to face a selected one of forward and rearward orientations.

6. The package of claim 1, wherein one of said bases is invertible to form a complementary top cover on the uppermost base such that said singular row of arcuate pockets on each of said bases engage edge portions of said first set of frying pans.

7. The package of claim 6, wherein each of said lands of said invertible base and said uppermost base is formed with interlocking teeth such that said invertible base and said uppermost base interlock together by means of said teeth to protect the uppermost layer of said frying pans.

8. The package of claim 6, wherein said plurality of bases is comprised of sets of seven, each of said sets being stacked vertically.

9. The package of claim 6, including a generally U-shaped, elongated support block having a radial surface provided with a pair of longitudinally extending stabilizing grooves engageable with said ribs formed on said arcuate surface on said invertible base and the lowermost of said bases.

10. The package of claim 9, wherein each of said bases and said support blocks is comprised of a recyclable material.

11. The package of claim 1, wherein each said singular row of arcuate pockets includes a ridge for supporting said frying pans.

12. The package of claim 1, wherein each said singular row of arcuate pockets includes a supporting groove for supporting said frying pans.

13. The package of claim 1, wherein each of said bases is recessed at the uppermost locus of said singular row of pockets to accommodate a support for each of said handles.

* * * * *